US009478875B2

(12) United States Patent
Il et al.

(10) Patent No.: US 9,478,875 B2
(45) Date of Patent: Oct. 25, 2016

(54) CONNECTING TERMINAL

(71) Applicant: Yazaki Corporation, Tokyo (JP)

(72) Inventors: Ryosuke Il, Shizuoka (JP); Atsuhito Saito, Shizuoka (JP); Shinichi Ikemoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/940,252

(22) Filed: Nov. 13, 2015

(65) Prior Publication Data

US 2016/0072203 A1 Mar. 10, 2016

Related U.S. Application Data

(63) Continuation of application No. PCT/JP2014/062182, filed on May 2, 2014.

(30) Foreign Application Priority Data

May 16, 2013 (JP) ..... 2013-104268
Nov. 7, 2013 (JP) ..... 2013-231121

(51) Int. Cl.
*H01R 4/48* (2006.01)
*H01R 13/11* (2006.01)
*H01R 4/18* (2006.01)

(52) U.S. Cl.
CPC ..... *H01R 4/48* (2013.01); *H01R 13/113* (2013.01); *H01R 4/185* (2013.01)

(58) Field of Classification Search
CPC ..... H01R 4/185; H01R 13/113; H01R 4/48
USPC ..... 439/816, 851, 852, 856, 857, 862, 843, 439/748
See application file for complete search history.

(56) References Cited

U.S. PATENT DOCUMENTS 5,707,254 A 1/1998 Chishima et al.
7,717,759 B2 * 5/2010 Ishigami ..... H01R 4/184 439/748
9,017,116 B2 * 4/2015 Ando ..... H01R 13/113 439/862

FOREIGN PATENT DOCUMENTS

JP 03-126370 U 12/1991
JP 06-060931 A 3/1994
JP 09-007670 A 1/1997
JP 11-040231 A 2/1999
JP 2000-133356 A 5/2000
JP 2002-237345 A 8/2002
JP 2002-373722 A 12/2002
JP 2010-027353 A 2/2010

OTHER PUBLICATIONS

International Search Report for PCT/JP2014/062182 dated Aug. 5, 2014.

* cited by examiner

*Primary Examiner* — Edwin A. Leon
(74) *Attorney, Agent, or Firm* — Sughrue Mion, PLLC

(57) ABSTRACT

A connecting terminal has a tubular part into which a mating terminal is to be inserted and a spring contact part extended from the tubular part and arranged in the tubular part, wherein insertion of the mating terminal into the tubular part is allowed by elastic deformation of the spring contact part and the mating terminal inserted into the tubular part is to be electrically connected with the connecting terminal using an elastic restoring force of the spring contact part as a contact load, and the connecting terminal has auxiliary spring parts extended from the tubular part and elastically deformed following elastic deformation of the spring contact part.

5 Claims, 8 Drawing Sheets

CONNECTING TERMINAL

CROSS REFERENCE TO RELATED APPLICATIONS

This application is a Continuation of PCT Application No. PCT/JP2014/062182, filed on May 2, 2014, and claims priority based on Japanese Patent Application No. 2013-104268 filed on May 16, 2013 and priority based on Japanese Patent Application No. 2013-231121 filed on Nov. 7, 2013, and the entire contents thereof are herein incorporated by reference.

TECHNICAL FIELD

The present invention relates to a connecting terminal having a spring contact part in a tubular part.

BACKGROUND ART

As one kind of the connecting terminal which electrically conducts with a mating terminal being allowed to be inserted into the connecting terminal, there exists the one that the spring contact part has been provided in a terminal insertion part into which the mating terminal is to be inserted. The spring contact part with one end thereof being made as a free end, is provided along an insertion direction of the mating terminal. The spring contact part is elastically deformed by insertion of the mating terminal into the terminal insertion part and the spring contact part comes into contact with the mating terminal and the connecting terminal conducts with the mating terminal by the elastic force therewith (see Patent Literatures 1 to 4).

FIGS. 12 and 13 show a conventional example of this type of connecting terminal. As shown in FIGS. 12 and 13, a connecting terminal 200 includes a tubular part 202 into which a plate-shaped mating terminal 201 is inserted, a spring contact part 203 extending from and arranging in the tubular part 202, and an electric wire connecting part 204 which connects to an electric wire W. The connecting terminal 200 are formed into a prescribed shape by shaping and bending a conductive plate member. Incidentally, the electric wire connecting part 204 has calking parts 204*a*, 204*b*. In a state where the connecting terminal 200 is housed in a terminal housing chamber 211 of a connector 210, the mating terminal 201 is inserted into the tubular part 202 of the connecting terminal 200.

A protruding part 205 protruding inside of the tubular part 202 is provided at a top plate part 202*a* of the tubular part 202. A position regulation part 206 which is formed by being cut and raised in an inward direction of the tubular part 202 from a baseplate part 202*b* is provided at the baseplate part 202*b* of the tubular part 202 and the position regulation part 206 regulates a displacement of the spring contact part 203 in a direction allowing insertion (a direction being orthogonal to the terminal insertion direction) of the mating terminal 201. The protruding part 205 is extended along the insertion direction of the mating terminal 201 and comes into contact with an upper surface of the mating terminal 201. The spring contact part 203 is provided with an indent 207 which protrudes toward the protruding part 205 and comes into contact with a lower surface of the mating terminal 201, and one pair of auxiliary spring parts 208 which respectively hang down from both sides of left and right of a free end (a rear end) of the spring contact part 203. A lower end of each of the auxiliary spring parts 208 can contact the baseplate part 202*b* of the tubular part 202.

When the mating terminal 201 is inserted into the tubular part 202, first, the spring contact part 203 is deflected and the lower ends of the auxiliary spring parts 208 contact the baseplate part 202*b* of the tubular part 202, and thereafter both of the spring contact part 203 and the auxiliary spring parts 208 are elastically deformed. As a result, a contact load between the spring contact part 203 and the mating terminal 201 increases. Accordingly, a spring force of the auxiliary spring parts 208 is applied to the spring contact part 203 and therefore a contact pressure itself with the mating terminal 201 is not reduced even in a structure of the spring pressure of the spring contact part 203 itself being reduced. Thereby, miniaturization and thinning of the plate thickness of the connecting terminal 200 can be achieved.

CITATION LIST

Patent Literature

Patent Literature 1: Japanese Patent Laid-Open Publication No. 09-7670

Patent Literature 2: Japanese Patent Laid-Open Publication No. 2010-27353

Patent Literature 3: Japanese Patent Laid-Open Publication No. 2000-133356

Patent Literature 4: Japanese Patent Laid-Open Publication No. 2002-237345

SUMMARY OF INVENTION

Technical Problem

In the above-mentioned conventional example, the auxiliary spring parts 208 are extended from the free end of the spring contact part 203. Accordingly, it is necessary to make leading end of extended portions of the spring contact part 203 into a complicated shape in order to form the auxiliary spring parts 208. Therefore, it has such a problem that workability—manufacturability of the connecting terminal 200 are poor.

In addition, since the auxiliary spring parts 208 are provided on the leading end of extended portions of the spring contact part 203, elastic deformations interact with each other. Therefore, a degradation in spring performance of one leads to a reduction in spring performance of the other and it has such a problem that reliability—durability as the spring are low.

The present invention has been made in order to solve the aforementioned problems and aims to provide a connecting terminal with high reliability and durability and good workability and manufacturability, therefore ensures a favorable conductive state with the mating terminal simultaneously.

Solution to Problem

A connecting terminal according to the present invention is conductively connected with a mating terminal by inserting the mating terminal into it includes a tubular part having a housing space into which the mating terminal is to be inserted, a spring contact part which is extended from the tubular part toward the inside of the tubular part and is elastically deformed by contacting with the mating terminal to be inserted into the housing space and auxiliary spring parts provided in the tubular part so as to support the spring contact part and apply to the spring contact part an elastic force in a direction toward the mating terminal which has been inserted into the housing space.

In the connecting terminal according to the present invention, the auxiliary spring parts are preferably provided laterally symmetrically in a pair.

In the connecting terminal according to the present invention, the auxiliary spring parts are preferably extended from the separated portions of the spring contact part of the tubular part.

In the connecting terminal according to the present invention, the auxiliary spring parts are preferably extended from side plate parts of the tubular part.

In the connecting terminal according to the present invention, the auxiliary spring parts are preferably formed integrally with the mutually facing side plate parts of the tubular part.

In the connecting terminal according to the present invention, the auxiliary spring parts are preferably have lock parts on the sides of free ends, and the spring contact part are preferably has arm parts which is locked to the lock parts.

DESCRIPTION OF EMBODIMENTS

First Embodiment

First, a first embodiment of the present invention will be described on the basis of the drawings.

FIGS. 1 to 6 show the first embodiment of the present invention.

Figure 1:
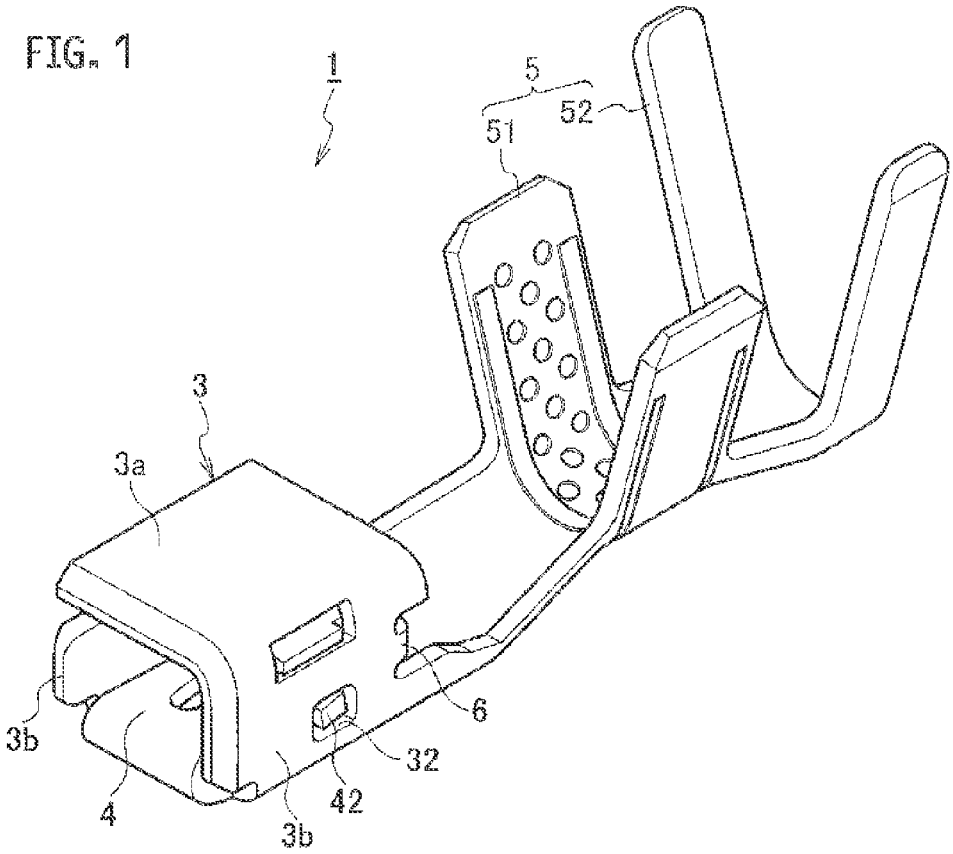
FIG. 1 is a perspective view of a connecting terminal according to a first embodiment of the present invention.
Figure 2:
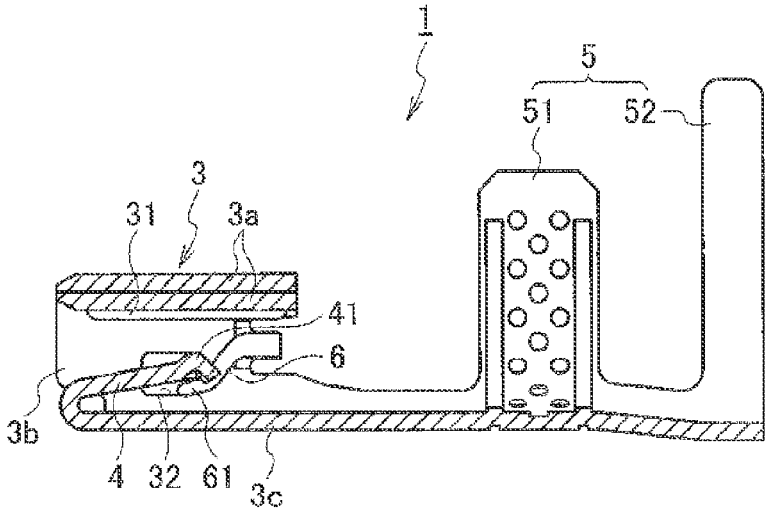
FIG. 2 is a sectional diagram of the connecting terminal according to the first embodiment of the present invention.
Figure 3:
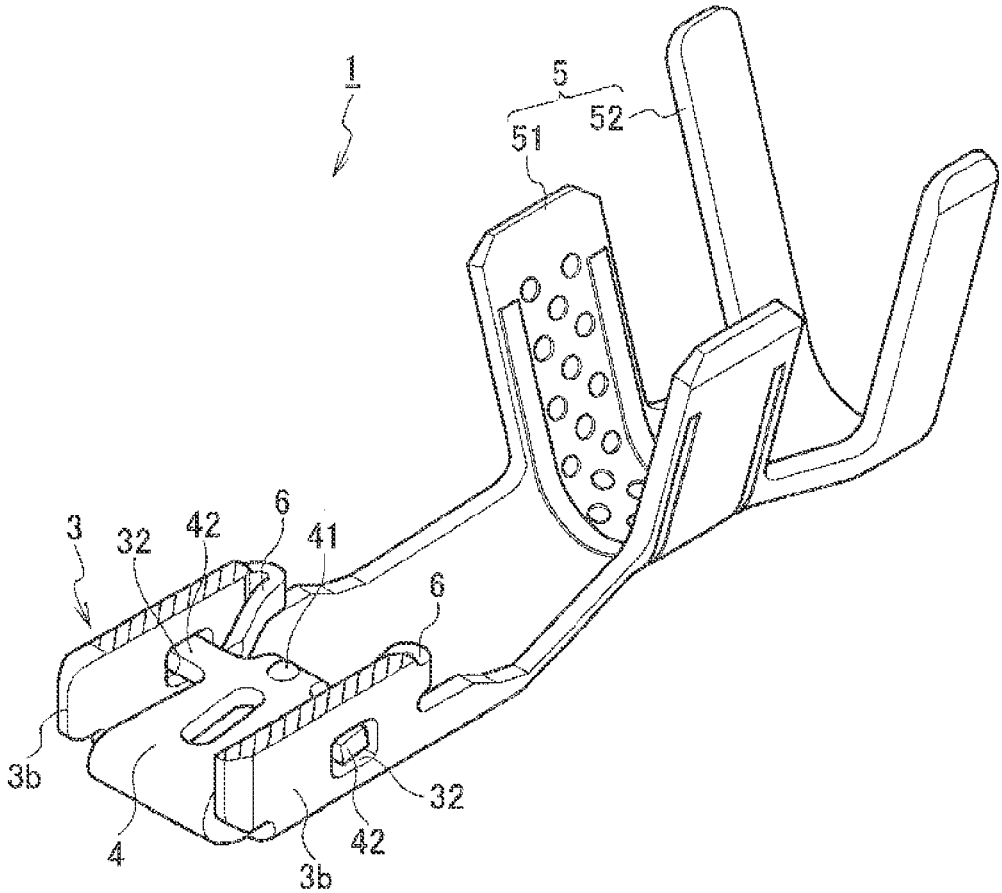
FIG. 3 is a partially cut-away perspective view of the connecting terminal according to the first embodiment of the present invention.
Figure 4A:
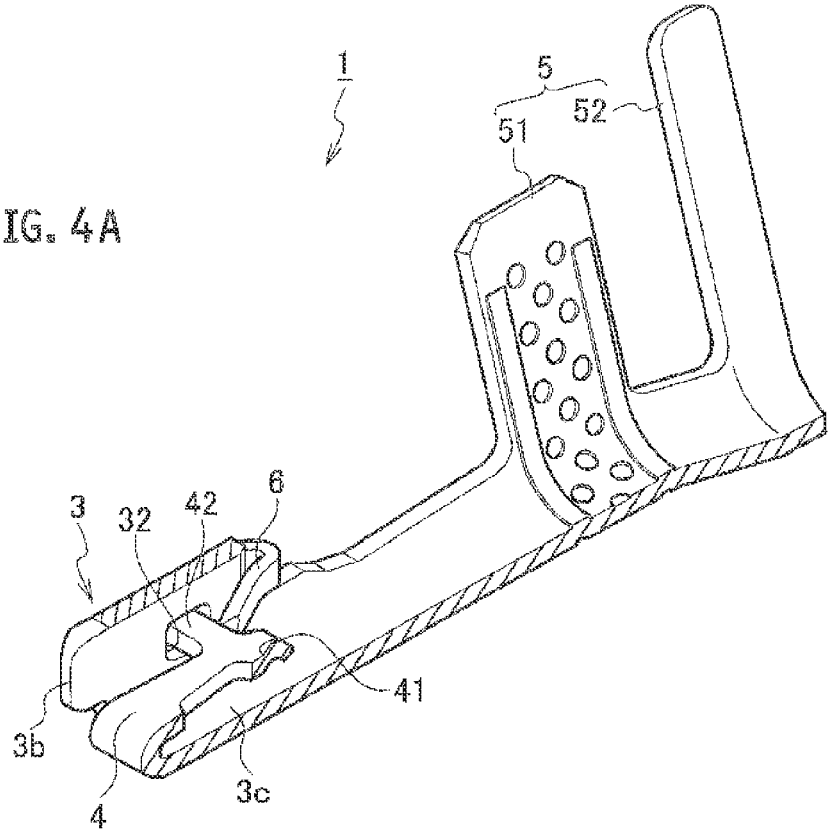
FIG. 4A shows the connecting terminal according to the first embodiment of the present invention, and is a partially cut-away perspective view of the connecting terminal viewed obliquely from the front.
Figure 4B:
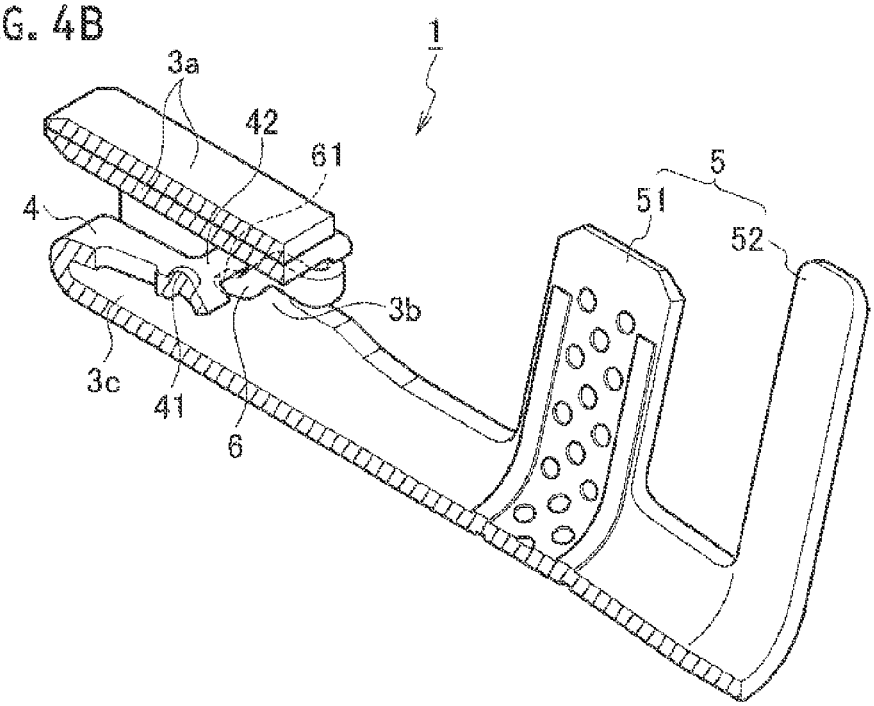
FIG. 4B shows the connecting terminal according to the first embodiment of the present invention, and is a partially cut-away perspective view of the connecting terminal viewed obliquely from behind.
Figure 5:
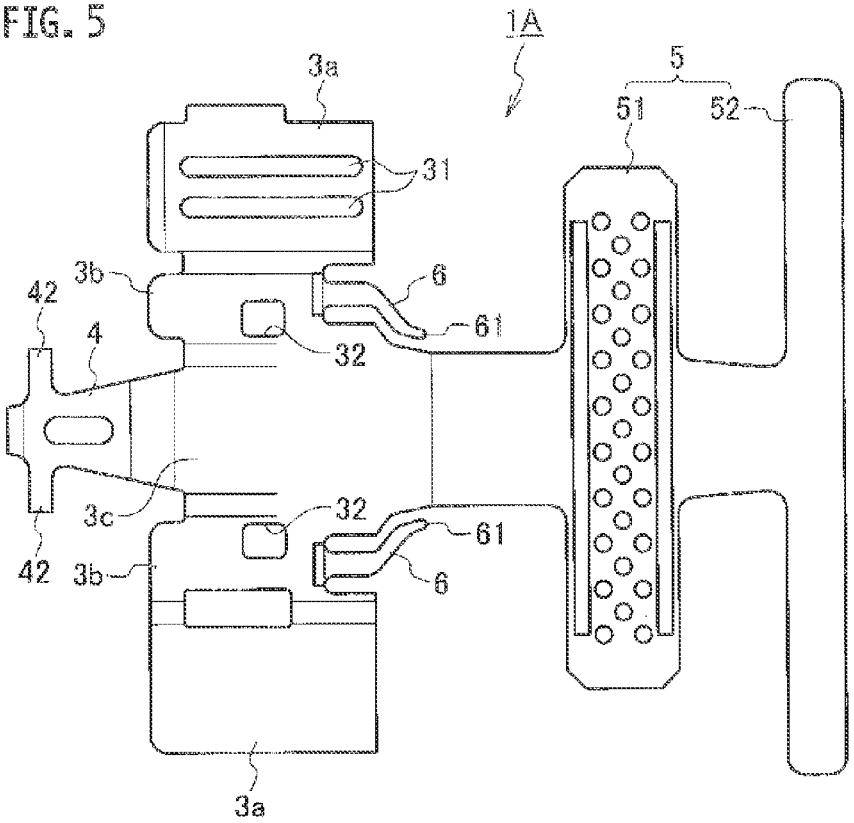
FIG. 5 is a plan view (a developed view of the connecting terminal) of a conductive plate member which forms the connecting terminal, according to the first embodiment of the present invention.
Figure 6:
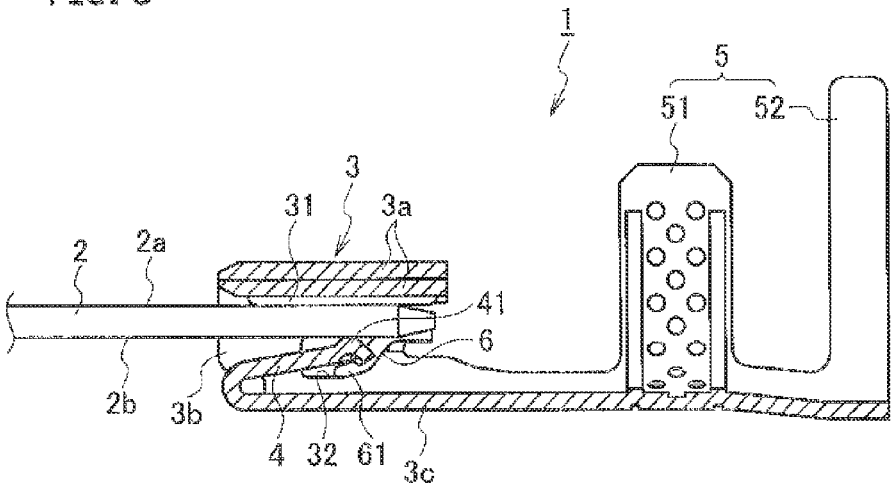
FIG. 6 is a sectional diagram of the connecting terminal according to the first embodiment of the present invention and is the diagram explaining a connection state with a mating terminal.

FIG. 1 is a perspective view of a connecting terminal according to the first embodiment of the present invention. FIG. 2 is a sectional diagram of the connecting terminal according to the first embodiment of the present invention. FIG. 3 is a partially cut-away perspective view of the connecting terminal according to the first embodiment of the present invention. FIGS. 4A and 4B show the connecting terminal according to the first embodiment of the present invention, in which FIG. 4A is a partially cut-away perspective view of the connecting terminal viewed obliquely from the front, and FIG. 4B is a partially cut-away perspective view of the connecting terminal viewed obliquely from behind. FIG. 5 is a plan view (a developed view of the connecting terminal) of a conductive plate member which forms the connecting terminal, according to the first embodiment of the present invention. FIG. 6 is a sectional diagram of the connecting terminal according to the first embodiment of the present invention and is the diagram explaining a connection state with a mating terminal.

A connecting terminal 1 of the present embodiment includes a tubular part 3 into which a plate-shaped mating terminal 2 is to be inserted, a spring contact part 4 which is extended from a baseplate part 3*c* of the tubular part 3 and arranged in the tubular part 3, and an electric wire caulking part 5 which is connected to an electric wire which is not shown. The spring contact part 4 is arranged in the tubular part 3 by being bent in a direction directing from the front end side of the tubular part 3 toward the inside of the tubular part 3. The connecting terminal 1 is formed by shaping and bending a conductive plate member 1A shown in FIG. 5 into a prescribed shape.

The tubular part 3 is formed into a hollow square tubular shape by a top plate part 3*a*, the side plate parts 3*b* of one pair of left and right and a baseplate part 3*c*. Auxiliary spring parts 6 are extendingly provided on the side plate parts 3*b* of one pair of left and right respectively. That is, the one pair of auxiliary spring parts 6 are formed to be bendable, for example, by notching each side plate part 3*b* which is a separated portion from the spring contact part 4 of the tubular part 3. The one pair of auxiliary spring parts 6 are bent roughly 180 degrees from the rear end side of the tubular part 3 toward the inside of the tubular part 3. Each auxiliary spring part 6 has a bent lock part 61, and the lock part 61 is arranged under an arm part 42, which will be described later. When the spring contact part 4 is elastically deformed, the arm part 42 of the spring contact part 4 contacts the lock part 61 of each auxiliary spring part 6, and each auxiliary spring part 6 is elastically deformed by following elastic deformation of the spring contact part 4.

The top plate part 3*a* is provided in a state where two sheets have been piled up vertically. One pair of projection parts 31 which contact with an upper surface 2*a* of the mating terminal 2 are formed on the lower-side top plate part 3*a*.

The spring contact part 4 is cut and raised inward from the front end side of the baseplate part 3*c* and is formed into a cantilever-like shape. The spring contact part 4 is folded back toward the rear end side and is inclined toward the top plate part 3*a* of the tubular part 3. The spring contact part 4 includes an indent 41 (a contact place) which contacts with the lower surface 2*b* of the mating terminal 2 and the arm parts 42 of one pair of left and right which protrude from the vicinity of the indent 41 respectively toward the both sides of left and right and are inserted into openings 32 in the side plate parts 3*b*. The arm parts 42 can move by a predetermined distance in the openings 32 in the side plate parts 3*b* when the spring contact part 4 is elastically deformed. Due to the arm part 42 stopping at edges of the openings 32, a displacement of the spring contact part 4 in the direction allowing (the direction orthogonal to the terminal insertion direction) of the mating terminal 2 insertion is regulated.

The electric wire caulking part 5 includes a conductor caulking piece 51 which crimps a conductor of the electric wire (illustration is omitted), and a coating caulking piece 52 which fixes the electric wire by being caulked to a coating part of the electric wire.

In the above-mentioned configuration, when the mating terminal 2 is inserted into the tubular part 3, the indent 41 of the spring contact part 4 which contacts with the mating terminal 2 to be depressed. Then, the spring contact part 4 is elastically deformed and the auxiliary spring parts 6 extended from the tubular part 3 are elastically deformed following elastic deformation of the spring contact part 4, and thereby the mating terminal 2 is allowed to be inserted and the spring contact part 4 and the mating terminal 2 are electrically connected together by using an elastic restoring force of the spring contact part 4 and the auxiliary spring parts 6 as a contact load.

As described above, the connecting terminal 1 has the spring contact part 4 in the tubular part 3 and the auxiliary spring parts 6 which are extended from the tubular part 3 and are elastically deformed following elastic deformation of the spring contact part 4. Accordingly, since the connecting terminal 1 uses the elastic restoring force of both of the spring contact part 4 and the auxiliary spring parts 6 as the contact load, even when miniaturization and so forth of the connecting terminal 1 are promoted, the contact load between the connecting terminal 1 and the mating terminal 2 can be increased. Then, due to the auxiliary spring parts 6 which is provided by extending from the tubular part 3 not from the spring contact part 4, there is no extended portion on the spring contact part 4. As a result, the workability—the manufacturability of the connecting terminal 1 will be improved. Moreover, due to the mutual elastic deformations of the spring contact part 4 and the auxiliary spring part 6 not mutually interacting, a reduction in spring performance of one does not lead to a reduction in spring performance of the other and the reliability—the durability are high. From the above, even when the connecting terminal 1 is miniaturized and weight reduction is promoted to reduce the plate thickness of the conductive plate member which forms the connecting terminal 1, the contact load between the connecting terminal 1 and the mating terminal 2 can be increased. Therefore, a good conductive state between the spring contact part 4 and the mating terminal 2 can be ensured. In addition, the connecting terminal 1 is good in workability—manufacturability and is high in reliability—durability.

The auxiliary spring parts 6 are provided in one pair at the laterally symmetrical positions on the both width-wise sides of the spring contact part 4. Accordingly, when the spring contact part 4 is elastically deformed, the one pair of the laterally symmetrically arranged auxiliary spring parts 6 support the spring contact part 4 on the both width-wise sides, and therefore, even in a case where the wide mating terminal 2 has been inserted, the uniform contact load can be obtained in the width direction of the mating terminal 2 on the contact surfaces of the spring contact part 4 and the mating terminal 2. That is, the contact load can be obtained between the spring contact part 4 and the mating terminal 2 in a stable state, and a favorable conductive state between the spring contact part 4 and the mating terminal 2 can be ensured. As a result, the connecting terminal 1 with high reliability—durability can be provided.

Since the auxiliary spring parts 6 are formed by partially notching the side plate parts 3*b* of the tubular part 3, the spring length dimension of the auxiliary spring parts 6 is easy to set. In addition, the auxiliary spring parts 6 are good in workability and manufacturability in comparison with the one that the auxiliary spring parts have been formed from the free end of the spring contact part as done conventionally.

Since each auxiliary spring part 6 is extended from the side plate part 3*b* which is parallel to the elastic deformation direction of the spring contact part 4 and is bent at an intermediate part, each auxiliary spring part 6 is strong against the load from the spring contact part 4 and a larger contact load between the spring contact part 4 and the mating terminal 2 can be obtained.

Although in the first embodiment, a case where the length of the tubular part 3 has been set comparatively short is illustrated, the present invention can obtain the same effect also in a case that the plate thickness of the conductive plate member which forms the connecting terminal is made thin.

Second Embodiment

Next, a second embodiment of the present invention will be described on the basis of the drawings.

Figure 7:
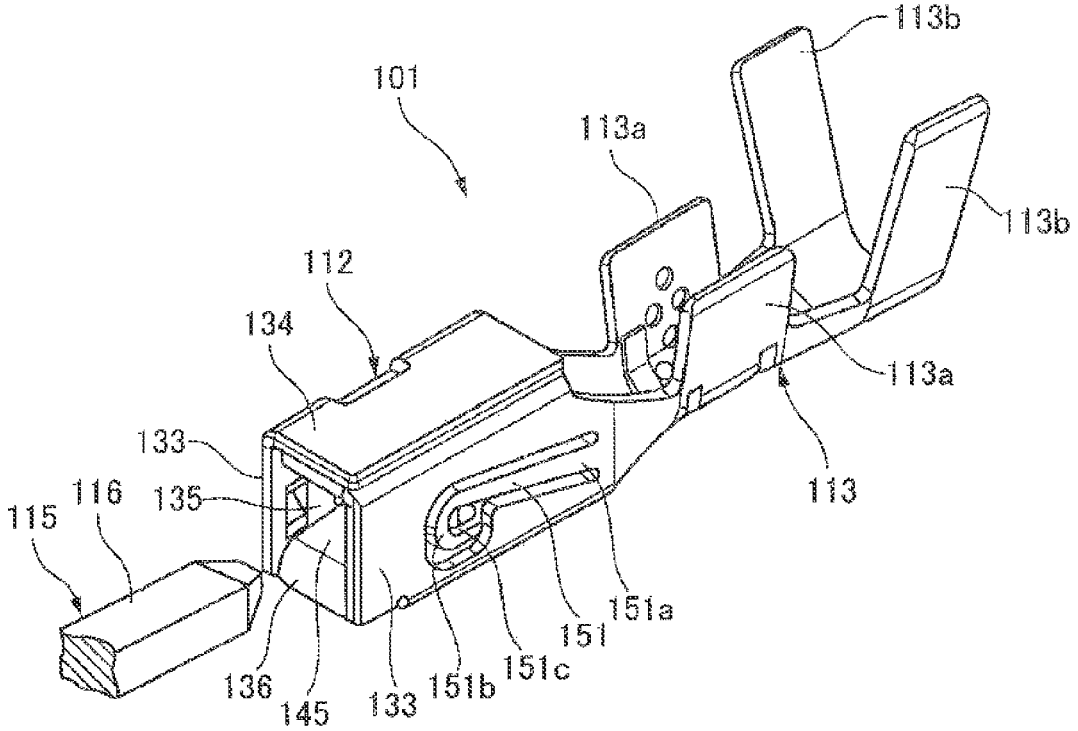
FIG. 7 is a perspective view of a connecting terminal according to a second embodiment of the present invention and a mating terminal to be connected thereto.
Figure 8:
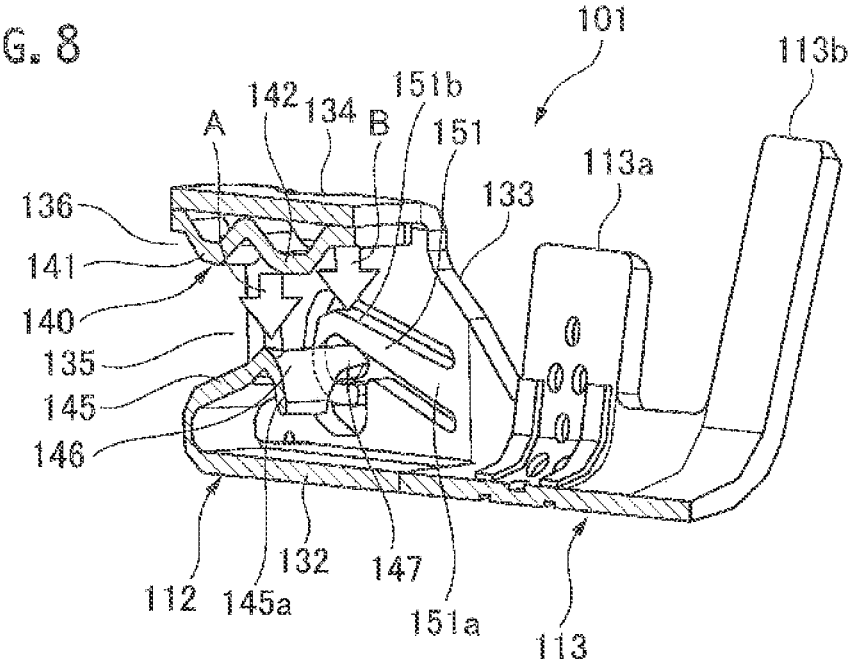
FIG. 8 shows the connecting terminal according to the second embodiment of the present invention and is a partially cut-away perspective view of the connecting terminal viewed obliquely from behind.
Figure 9:
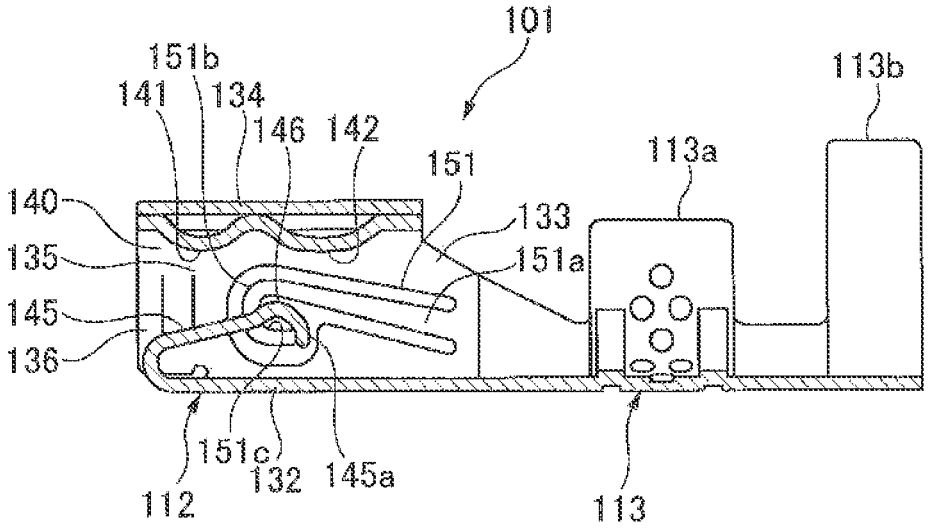
FIG. 9 is a sectional diagram of the connecting terminal according to the second embodiment of the present invention.
Figure 10:
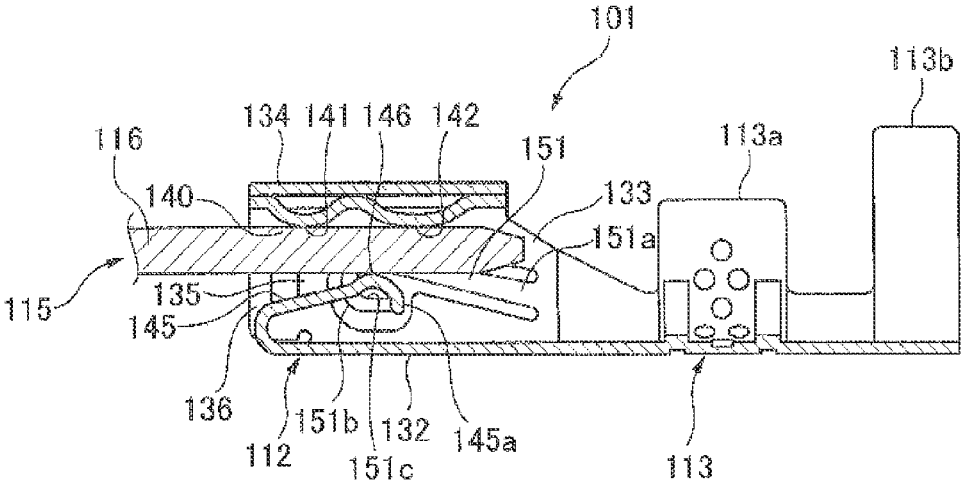
FIG. 10 is a sectional diagram of the connecting terminal according to the second embodiment of the present invention and is the diagram explaining the connection state with the mating terminal.

FIGS. 7 to 10 show the second embodiment of the present invention. FIG. 7 is a perspective view of a connecting terminal according to the second embodiment of the present invention and a mating terminal to be connected thereto. FIG. 8 shows the connecting terminal according to the second embodiment of the present invention, and is a partially cut-away perspective view of the connecting terminal viewed obliquely from behind (the perspective view that the width-wise center of the connecting terminal has been viewed in section). FIG. 9 is a sectional diagram of the connecting terminal according to the second embodiment of the present invention. FIG. 10 is a sectional diagram of the connecting terminal according to the second embodiment of the present invention and is the diagram explaining the connection state with the mating terminal.

As shown in FIG. 7, a connecting terminal 101 according to the present embodiment includes a tubular part 112 which is formed into a hollow square-tubular shape, and an electric wire caulking part 113 extends from a rear end of this tubular part 112. This connecting terminal 101 is shaped by press-working a conductive metal plate such as copper.

A tab piece 116 of a mating terminal 115 is inserted into the tubular part 112 from its leading end side. Thereby, the mating terminal 115 is connected to the connecting terminal 101 and these connecting terminal 101 and mating terminal 115 are conducted together.

The electric wire caulking part 113 includes a conductor caulking piece 113*a* which crimps the conductor of the electric wire (illustration is omitted), and a coating caulking piece 113*b* which fixes the electric wire by being caulked to the coating part of the electric wire.

As shown in FIGS. 8 and 9, the tubular part 112 of the connecting terminal 101 has a baseplate part 132 which configures the bottom part, one pair of side plate parts 133 which vertically rise from width-wise both side edge parts of this baseplate part 132, and a top plate part 134 which is provided across edge parts of these side plate parts 133 on the opposite side of the baseplate part 132, and the tubular part 112 is formed into a rectangular shape in front view. The top plate part 134 is extended from an upper edge part of one side plate part 133 toward the other side plate part 133 side. This tubular part 112 is made as a housing space 135 in its inner part, and a front end side on the opposite side of the electric wire caulking part 113 is made as an insertion port 136 through which the tab piece 116 of the mating terminal 115 is to be inserted/extracted. The mating terminal 115 can be inserted into the housing space 135 through the insertion port 136.

A contact part 140 is provided on the upper side of the housing space 135 of the tubular part 112. This contact part 140 is extended from an upper edge part of the other side plate part 133 toward one side plate part 133 so as to overlap the top plate part 134. On this contact part 140, two contacts 141, 142 which project toward the inside of the housing space 135 are arrayed by leaving a space between them along the insertion direction of the tab piece 116.

In the tubular part 112, a spring contact part 145 is provided in the vicinity of the baseplate part 132 in the housing space 135. This spring contact part 145 is coupled with the baseplate part 132 on the front end side of the tubular part 112 and is extended in the insertion direction along the insertion direction of the tab piece 116. This spring contact part 145 is formed by bending a metal piece which extends toward the front end side of the baseplate part 132 when the connecting terminal 101 is folded and bent. This spring contact part 145 is extended toward the inside of the tubular part 112 at its free end 145*a*, and the spring contact part 145 is arranged in the housing space 135. A contact 146 which projects into the tubular part 112 is provided on a part adjacent to the free end 145*a* of the spring contact part 145. On the both side parts of the contact 146 of the spring contact part 145, arm parts 147 which project from the inside of the tubular part 112 outward on the both side faces of the tubular part 112 are formed.

An auxiliary spring part 151 is formed on each of the one pair of side plate parts 133 which configure the tubular part 112. Thereby, the one pair of side plate parts 133 have a structure wherein one pair of auxiliary spring parts 151 are provided at positions corresponding to the both sides of the spring contact part 145 of the connecting terminal 101. These auxiliary spring parts 151 have base ends 151*a* on the forward side of the insertion direction of the tab piece 116, that is, the rear end side of the tubular part 112 and the auxiliary spring parts 151 are coupled to the side plate parts 133 via the base ends 151*a*. The free end 151*b* of auxiliary spring part 151 is extended toward the insertion port 136 while directing toward the inside of the tubular part 112 thereof.

The auxiliary spring part 151 is bent downward and folded back at the free end 151*b* and a concave lock part 151*c* is formed in this part so folded back. It is made into a structure that the arm part 147 of the spring contact part 145 is inserted into and locked to the lock part 151*c* formed at the free end 151*b* and the auxiliary spring part 151 supports the spring contact part 145. This auxiliary spring part 151 is the one formed integrally with the side plate part 133 by punching and a gap is formed around the auxiliary spring part 151. Since there is the gap, the auxiliary spring part 151 can be made to deform elastically almost in a plane that the side plate part 133 is located.

Next, a case where the mating terminal 115 which is connected to the connecting terminal 101 of the above-mentioned structure will be described.

When the tab piece 116 of the mating terminal 115 approaches and is inserted into the housing space 135 through the insertion port 136 of the tubular part 112 of the connecting terminal 101, the leading end part of the tab piece 116 contacts with the contact 141 of the contact part 140 and the contact 146 of the spring contact part 145.

When the tab piece 116 is further pushed into the housing space 135, the spring contact part 145 is pushed downward (a direction of arrow A shown in FIG. 8) by the tab piece 116, is elastically deformed and deflects as shown in FIG. 10. In addition, since the arm part 147 of the spring contact part 145 is locked to the lock part 151*c* of the auxiliary spring part 151, when the spring contact part 145 is pushed downward, the auxiliary spring part 151 is pushed downward (a direction of arrow B shown in FIG. 8), is elastically deformed and deflects. In addition, in this state, the tab piece 116 is in a contacting state also with the contact 142 of the contact part 140. That is, the state of the tab piece 116 changes into a connection state of contacting with the contacts 141, 142 of the contact part 140, and the contact 146 of the spring contact part 145.

In this connection state, the contact 146 of the spring contact part 145 which is elastically deformed is pressed against the tab piece 116 by the elastic force of the spring contact part 145. In addition, the elastic force of the auxiliary spring parts 151 on the both sides which are elastically deformed is applied to the spring contact part 145. Thereby, the contact 146 of the spring contact part 145 is pushed to the tab piece 116 by the elastic force of the auxiliary spring parts 151 which are arranged at positions to support the spring contact part 145 on the both sides of the spring contact part 145, together with the elastic force of the spring contact part 145 itself.

In this way, in the connecting terminal 101 according to the above mentioned embodiment, the auxiliary spring parts 151 which apply the elastic force directed toward the tab piece 116 side of the mating terminal 115 which has been inserted into the housing space 135 are provided for the respective ones of the one pair side plate parts 133 at the positions where they support the spring contact part 145 on the both sides of the spring contact part 145. Therefore, the spring contact part 145 is pushed to the tab piece 116 of the mating terminal 115 by the elastic force of the auxiliary spring parts 151, together with its own elastic force. Moreover, since the auxiliary spring parts 151 are provided in the tubular part 112, in particular, for the respective ones of one pair of side plate parts 133 in the tubular part 112 at the positions to support the spring contact part 145 on the both sides of the spring contact part 145, the elastic force of the auxiliary spring parts 151 can be applied to the both sides of the spring contact part 145 in a well-balanced manner. Thereby, the spring contact part 145 contacts with the tab piece 116 of the mating terminal 115 under a stable and large load, and the connecting terminal 101 and the mating terminal 115 are conductively connected together with high reliability.

Accordingly, since the elastic force of the spring contact part 145 is sufficiently compensated for by the structure of the one pair of auxiliary spring parts 151 even when the length has been shortened and the plate thickness has been thinned in order to promote miniaturization, an amount of deflection, a contact load and an elastic limit value and so forth of the spring contact part 145 are maintained equally to those before miniaturization at the connection state with the tab piece 116 of the mating terminal 115, and hereby, the contact force between the spring contact part 145 and the mating terminal 115 can be sufficiently ensured. Thus, miniaturization of the connecting terminal 101 can be attained while ensuring the favorable conductive state between the spring contact part 145 and the mating terminal 115.

Moreover, since the auxiliary spring parts 151 have been formed integrally with the one pair of mutually facing side plate parts 133 facing each other of the tubular part 112, the contact force of the spring contact part 145 against the tab piece 116 of the mating terminal 115 can be improved without inducing an increase in cost.

In addition, the elastic force of the auxiliary spring parts 151 can be easily applied to the spring contact part 145 by configuring so as to make the lock parts 151*c* on the free end 151*b* sides of the auxiliary spring parts 151 lock the arm parts 147 of the spring contact part 145.

Here, further superiority of the present invention will be described by the comparison between a reference example and the present embodiment.

Figure 11:
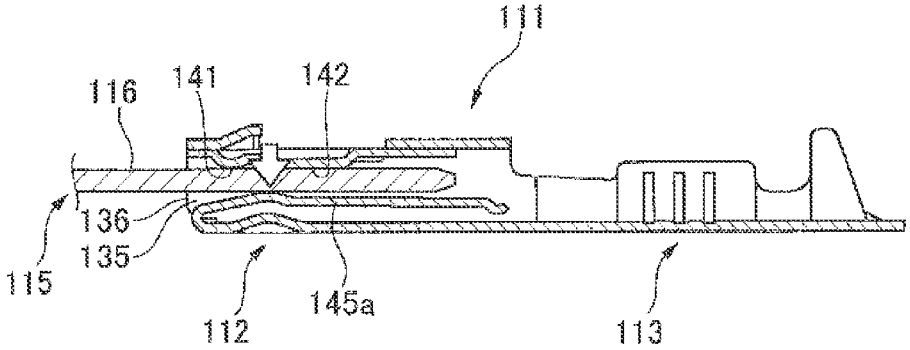
FIG. 11 is a sectional diagram of a connecting terminal according to a reference example.
Figure 12:
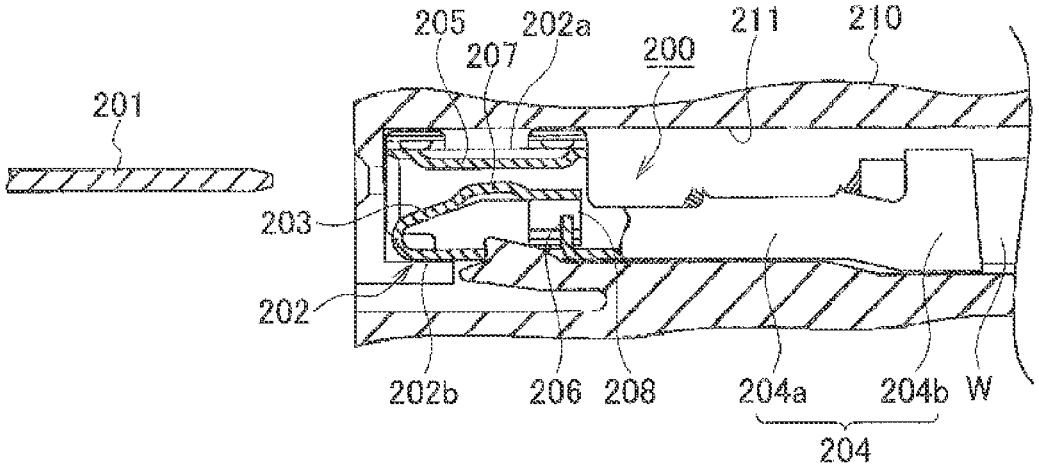
FIG. 12 shows a sectional diagram of a connecting terminal as a conventional example.
Figure 13:
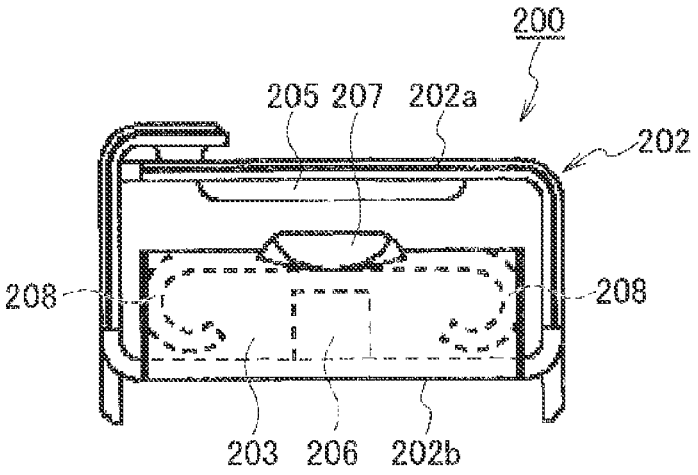
FIG. 13 shows a front view of the connecting terminal as a conventional example.

FIG. 11 is a sectional diagram of a connecting terminal according to the reference example. As shown in FIG. 11, in a connecting terminal 111 according to the reference example, the auxiliary spring parts 151 are not provided. When the tab piece 116 is inserted into the housing space 135, the connecting terminal 111 becomes a connection state where the contacts 141, 142 of the contact part 140 and the contact 146 of the spring contact part 145 contact with each other.

In this connection state, the contact 146 of the spring contact part 145 which is elastically deformed is pushed to the tab piece 116 by the elastic force, and therefore the connecting terminal 111 and the mating terminal 115 are conducted together.

Incidentally, in the connecting terminal 111 according to the reference example with no provision of the auxiliary spring parts 151, when the length of the spring contact part 145 is shortened and the plate thickness is thinned for miniaturization, the elastic force of the spring contact part 145 may be weakened and the stable contact load with the tab piece 116 of the mating terminal 115 may not be obtained. As a result, defective contact with the mating terminal 115 occurs and the favorable conductive state cannot be obtained.

In addition, in order to compensate for the elastic force of the spring contact part 145, in the connecting terminal 111, it is conceivable to provide an auxiliary spring on the spring contact part 145 along a length direction which is the insertion direction of the tab piece 116 of the mating terminal 115. However, in a structure that the auxiliary spring is provided along the length direction, it is difficult to attain miniaturization of the connecting terminal 111 by shortening the length of the connecting terminal 111. In addition, when miniaturization can be attained by thinning the plate thickness, the elastic force of both of the spring contact part 145 and the auxiliary spring is weakened and therefore the elastic force of the spring contact part 145 cannot be sufficiently compensated for by the elastic force of the auxiliary spring.

In contrast, in the connecting terminal 101 according to the present embodiment, since the auxiliary spring parts 151 are provided in the tubular part 112 so as to support the spring contact part 145 on the both sides of the spring contact part 145, the connecting terminal 101 can be miniaturized by shortening the entire length without weakening the elastic force of the spring contact part 145 and, further, the auxiliary spring parts 151 can be miniaturized. Moreover, even when the elastic force of the spring contact part 145 and the auxiliary spring part 151 becomes weakened due to a promotion of miniaturization by thinning the plate thickness, the elastic force of the one pair of auxiliary spring parts 151 can be applied to the spring contact part 145 and the elastic force of the spring contact part 145 can be sufficiently compensated for.

Although the present invention has been described so far, these embodiments are mere illustrations which have been described for easy understanding of the present invention, and the present invention is not limited to the embodiments and modifications, improvements and so forth can be made appropriately. As other matters, the member, the shape, the size, the number, the installation place and so forth of each constitutional element in the above-mentioned embodiments are optional as long as they are the ones which can attain the present invention and there is no limitation on them. The technical scope of the present invention is not limited to specific technical matters disclosed in the above-mentioned embodiments and covers various alterations, modifications, alternative technologies and so forth which would be easily derived therefrom.

INDUSTRIAL APPLICABILITY

According to the present invention, since the elastic restoring force of both of the spring contact part and the auxiliary spring parts is used as the contact load, the contact load between it and the mating terminal can be increased even when miniaturization and so forth are attained. The auxiliary spring parts are provided so as to extend from the tubular part, not from the spring contact part, and elastic deformations of both of the spring contact part and the auxiliary spring parts do not mutually interact. Therefore, the contact load between the connecting terminal and the mating terminal can be increased even when miniaturization and so forth of the connecting terminal are attained. As a result, the workability and the manufacturability are good, and moreover, the reliability and the durability are high.

REFERENCE SIGNS LIST

1, 101 connecting terminal
2, 115 mating terminal
3, 112 tubular part
3*b*, 133 side plate part (portion separated from spring contact part)
4, 145 spring contact part
6, 151 auxiliary spring part

The invention claimed is:

1. A connecting terminal to be conductively connected with a mating terminal by inserting the mating terminal into it, comprising:

a tubular part having a housing space into which the mating terminal is to be inserted;

a spring contact part which is extended from the tubular part toward the inside of the tubular part and is elastically deformed by contacting with the mating terminal to be inserted into the housing space; and auxiliary spring parts which are provided in the tubular part so as to support the spring contact part and apply to the spring contact part an elastic force in a direction toward the mating terminal which has been inserted into the housing space, wherein the auxiliary spring parts are part of side plate parts facing each other of the tubular part, the auxiliary spring parts are substantially located in planes that the side plate parts are located, a gap is formed around the auxiliary spring parts and located between the auxiliary spring parts and the side plate parts, the auxiliary spring parts can deform elastically substantially in the planes that the side plate parts are located due to the gap, the spring contact part comprises arm parts, the side plate parts comprise openings, and the arm parts are at least partially located inside the openings.

2. The connecting terminal according to claim 1, wherein the auxiliary spring parts are provided laterally symmetrically in a pair.

3. The connecting terminal according to claim 1, wherein the auxiliary spring parts are extended from portions separated from the spring contact part of the tubular part.

4. The connecting terminal according to claim 1, wherein the auxiliary spring parts are extended from the side plate parts of the tubular part.

5. The connecting terminal according to claim 1, wherein the auxiliary spring parts have lock parts on sides of free ends, and the arm parts are locked to the lock parts.

* * * * *